US010240422B2

(12) United States Patent
Fripp et al.

(10) Patent No.: US 10,240,422 B2
(45) Date of Patent: Mar. 26, 2019

(54) REINFORCED DRILL PIPE SEAL WITH FLOATING BACKUP LAYER

(71) Applicant: Halliburton Energy Services, Inc., Houston, TX (US)

(72) Inventors: Michael Linley Fripp, Dallas, TX (US); Larry Lucius Cox, Richardson, TX (US); Christopher Allen Grace, Coppell, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 259 days.

(21) Appl. No.: 14/910,220

(22) PCT Filed: Sep. 24, 2013

(86) PCT No.: PCT/US2013/061289
§ 371 (c)(1),
(2) Date: Feb. 4, 2016

(87) PCT Pub. No.: WO2015/047214
PCT Pub. Date: Apr. 2, 2015

(65) Prior Publication Data

US 2016/0194929 A1 Jul. 7, 2016

(51) Int. Cl.
*E21B 33/03* (2006.01)
*E21B 33/068* (2006.01)
*E21B 33/08* (2006.01)

(52) U.S. Cl.
CPC ..... *E21B 33/03* (2013.01); *E21B 33/068* (2013.01); *E21B 33/085* (2013.01)

(58) Field of Classification Search
CPC ..... E21B 33/03; E21B 33/068; E21B 33/085; E21B 33/04
See application file for complete search history.

(56) References Cited

U.S. PATENT DOCUMENTS 2,143,106 A 1/1939 Freedlander
2,762,638 A 9/1956 Brown
(Continued)

FOREIGN PATENT DOCUMENTS

EP 0447204 A2 9/1991
WO WO2013102131 7/2013

OTHER PUBLICATIONS

Stodle, T., "Managed Pressure Drilling from Floaters—Existing Technology & Where do we go from here," XP055405587, University of Stavanger, Faculty of Science and Technology, Jun. 5, 2003, 83 pages.
(Continued)

*Primary Examiner* — Eugene G Byrd
(74) *Attorney, Agent, or Firm* — John W. Wustenberg; Parker Justiss, P.C.

(57) ABSTRACT

A reinforced seal for maintaining a pressure differential in a well bore includes an elastomeric layer and a backup layer between a drill pipe and the elastomeric layer at the wellhead. The backup layer has a first end portion, a second end portion, and a tapered portion, wherein the first end portion has a larger inner diameter than the second end portion and the tapered portion connects the first end portion and second end portion. In addition, the backup layer includes a plurality of slats substantially aligned with the longitudinal axis of the drill pipe and arranged circumferentially about the perimeter of the drill pipe along the internal surface of the backup layer such that a portion of each slat underlies a portion of each adjacent slat.

17 Claims, 6 Drawing Sheets

(56) References Cited

U.S. PATENT DOCUMENTS

| | | | | |
|---|---|---|---|---|
| 3,029,083 | A | 4/1962 | Wilde | |
| 3,160,211 | A * | 12/1964 | Malone | E21B 33/127 166/187 |
| 4,372,563 | A * | 2/1983 | Diehl | E21B 33/03 166/124 |
| 4,428,592 | A | 1/1984 | Shaffer | |
| 4,441,551 | A | 4/1984 | Biffle | |
| 5,101,913 | A | 4/1992 | Stockley et al. | |
| 5,701,959 | A | 12/1997 | Hushbeck et al. | |
| 6,695,051 | B2 | 2/2004 | Smith et al. | |
| 6,769,491 | B2 * | 8/2004 | Zimmerman | E21B 33/1204 166/138 |
| 7,231,985 | B2 * | 6/2007 | Cook | E21B 17/08 166/207 |
| 7,578,342 | B2 | 8/2009 | Brennan, III et al. | |
| 7,896,085 | B2 * | 3/2011 | Nutley | E21B 17/10 166/207 |
| 7,980,300 | B2 | 7/2011 | Robert et al. | |
| 8,393,388 | B2 | 3/2013 | Bishop et al. | |
| 8,403,036 | B2 | 3/2013 | Neer et al. | |
| 9,869,148 | B2 * | 1/2018 | Jahnke | E21B 33/038 |
| 2007/0107910 | A1 * | 5/2007 | McGuire | E21B 17/1007 166/379 |
| 2007/0290454 | A1 | 12/2007 | Garrison et al. | |
| 2008/0060821 | A1 | 3/2008 | Smith et al. | |
| 2008/0169617 | A1 * | 7/2008 | Filliol | B29C 45/14778 277/636 |
| 2010/0101804 | A1 | 4/2010 | Vinson et al. | |
| 2011/0101615 | A1 | 5/2011 | Clarke | |
| 2011/0174501 | A1 * | 7/2011 | Struthers | E21B 17/025 166/379 |
| 2011/0277255 | A1 | 11/2011 | Harper | |
| 2011/0315404 | A1 | 12/2011 | Bailey et al. | |
| 2012/0037355 | A1 | 2/2012 | Bishop et al. | |
| 2012/0261888 | A1 * | 10/2012 | Borden | E21B 33/085 277/562 |
| 2013/0140034 | A1 * | 6/2013 | Ghasripoor | E21B 33/085 166/342 |
| 2013/0228340 | A1 * | 9/2013 | Cain | E21B 33/038 166/367 |

OTHER PUBLICATIONS

PCT International Search Report and Written Opinion of the International Searching Authority, PCT/US2013/061289, dated Jun. 2, 2014, 14 pages.

"TAM-J Multiple Set Inflatable Packer System", TAM International; www.tamiintl.com/images/pdfs/brochures/TAM_J_Brochure.pdf; ISO 9001: published in 2008, 8 pages.

* cited by examiner

REINFORCED DRILL PIPE SEAL WITH FLOATING BACKUP LAYER

This application is a U.S. National Phase Application under 35 U.S.C. § 371 and claims the benefit of priority to PCT Application Serial No. PCT/US2013/061289, filed on Sep. 24, 2013, the contents of which are hereby incorporated by reference.

1. FIELD OF THE INVENTION

The present disclosure relates generally to the recovery of subterranean deposits, and more specifically to a mechanism for sealing an interface between a drill string and a well head in a managed pressure drilling environment.

2. DESCRIPTION OF RELATED ART

Wells are drilled at various depths to access and produce oil, gas, minerals, and other naturally-occurring deposits from subterranean geological formations. The drilling of a well is typically accomplished with a drill bit that is rotated within the well to advance the well by removing topsoil, sand, clay, limestone, calcites, dolomites, or other materials. The drill bit is typically attached to a drill string that may be rotated to drive the drill bit and within which drilling fluid, referred to as "drilling mud" or "mud", may be delivered downhole. The drilling mud is used to cool and lubricate the drill bit and downhole equipment and, as such, is circulated through the drill string and back to the surface in an annulus formed by the space between the drill string and wall of the well bore.

In managed pressure drilling ("MPD"), an adaptive drilling procedure may be used that involves more precisely controlling the pressure of the fluid in the annulus throughout the wellbore. In an MPD system, it may be necessary to ascertain the downhole pressure gradient through the wellbore and subsequently manage the pressure of fluid within the annulus in zones at varying depths in the wellbore. This management of pressure may be done by isolating different zones within the wellbore from one another so that the pressure in the annulus can be separately controlled in each zone. A first such zone may be at or near a wellhead, which is the location of the interface between the topmost subterranean portion of the well and the adjacent environment, such as air or water at the surface of the well.

In a managed pressure system, sealing devices are used to maintain pressure in the wellbore and to prevent unwanted fluid or pressure loss. Such sealing devices may be located at or near the wellhead, and may be included in mechanisms that are installed above the wellhead, such as rotating control devices that assist with the delivery of pressurized fluid to the wellbore.

DETAILED DESCRIPTION OF ILLUSTRATIVE EMBODIMENTS

In the following detailed description of the illustrative embodiments, reference is made to the accompanying drawings that form a part hereof. These embodiments are described in sufficient detail to enable those skilled in the art to practice the invention. It is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

As noted above, managed pressure drilling ("MPD"), involves more precisely controlling the pressure of the fluid in the annulus throughout the wellbore, and therefore involves creating a seal against a drill pipe as the pipe rotates and travels into a wellbore. More generally, managed pressure drilling is a drilling optimization solution that can reduce well construction costs as it allows drilling with minimal overbalance pressure. Managed pressure drilling may help you reach previously undrillable targets, eliminate casing strings, lower mud costs, reduce nonproductive time associated with pressure events, and minimize formation damage while allowing precise control of the wellbore.

In conventional drilling, the wellbore is open to the atmosphere and drilling fluids flow freely across a shaker to a return pit. Managed pressure drilling solution creates a closed loop system by utilizing a managed environment that allows precise control of bottom hole pressure and timely detection and mitigation of kicks and mud losses.

Figure 1:
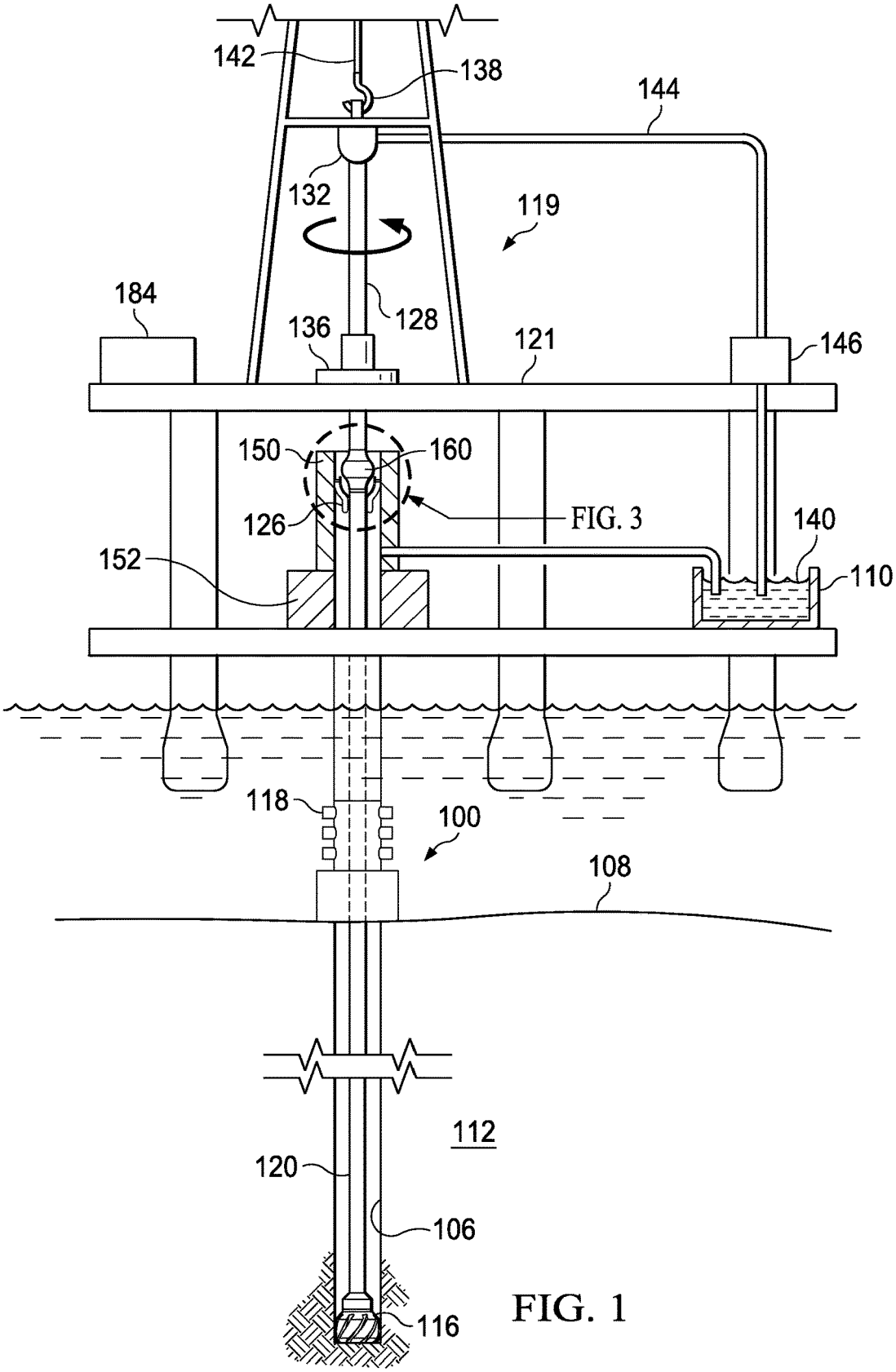
FIG. 1 is a schematic, front view of a subsea well that includes a managed pressure drilling system.

Referring now to FIG. 1, a managed pressure drilling system 100 is deployed in a well 102 having a wellbore 106 that extends from a surface 108 of the well 102 to or through a subterranean formation 112. The managed pressure drilling system 100 includes a number of components above or proximate the wellhead that function to seal the well 102 from the external environment, including a blow-out preventer 152 and rotating control device 150. The rotating control device 150 includes one or more bearing-mounted seals that compress against a surface of a drill pipe to provide a rotating, sealed interface between the rotating control device 150 and drill pipe. The seal may be flexible to allow for tool joints having an enlarged diameter relative to the normal outer diameter of the drill pipe to pass through the seal at the wellhead element as the drill pipe is lowered into a wellbore. An improved method for providing such a seal is described herein.

In general, the seal may be a reinforced seal that creates a fluid seal against the drill pipe to prevent the unwanted egress of drilling fluid or other fluids from the wellbore. The seal may be relied upon to hold a pressure differential and may be mechanically robust to allow expansion so that tool joint connections may pass through the seal. While the seal may be primarily an elastomeric seal, a seal that is formed only from elastomer may fail at high pressure differentials. To prevent such undesired failures, a metal backup ring may be bonded to the elastomer to reinforce the elastomeric seal. The metal backup ring may be segmented since the wellhead element expands and contracts around tool joints as the drill string is lowered into the well. However, such a segmented metal backup ring, if bonded to the elastomer, may create localized strain concentrations in the elastomer at locations that correspond to gaps in the segments of the metal backup ring. This too may result in premature failure of the elastomer. In the illustrative embodiments described below, high-expansion sealing mechanisms with metal backup layers are described that provide an elastomeric seal reinforced by a modified, segmented reinforcement layer. The high-expansion sealing mechanism seals to the drill pipe, endures a high pressure differential, and expands to allow the passage of a tool connection therethrough.

Figure 2:
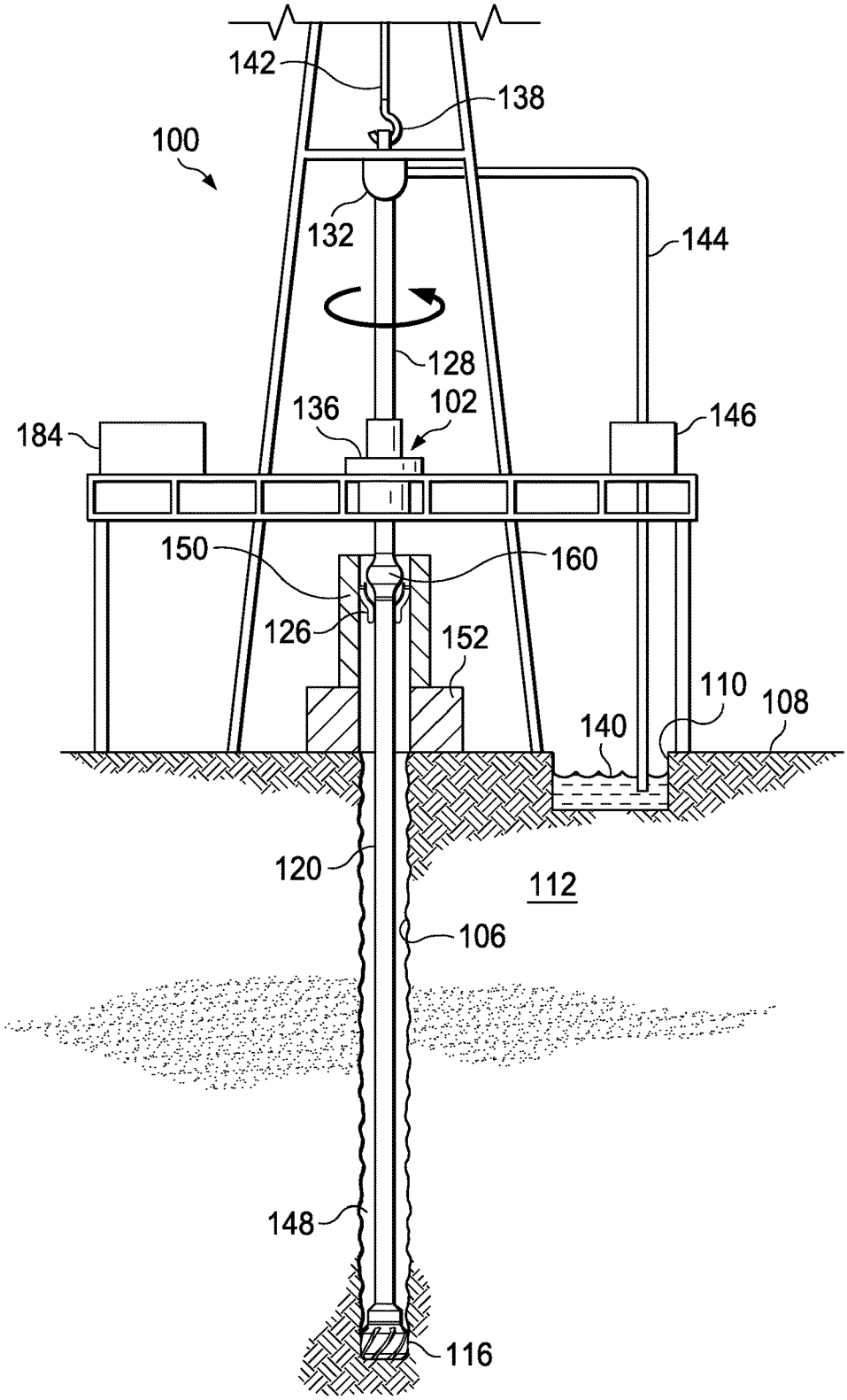
FIG. 2 is a schematic, front view of an on-shore well that includes a managed pressure drilling system.

In FIG. 1, the well 102 is illustrated in a subsea configuration, with a reinforced seal 126 included in a rotating control device 150 above the wellhead 118 and blow-out preventer 152. In another embodiment, the reinforced seal 126 may be installed at a wellhead or in other locations within a wellbore where such a seal is desired. In other installations, the rotating control device 150 and associated reinforced seal 126 may be deployed onshore, as shown in FIG. 2. FIGS. 1 and 2 each illustrate possible implementations of a system that includes the reinforced seal 126 within a rotational control device 150. While the following description of the reinforced seal 126 focuses primarily on the use of the reinforced seal 126 within a rotational control device 150 in the subsea well 102 of FIG. 1, the reinforced seal 126 may be used instead in the well configurations illustrated in FIG. 2, as well as in other well configurations where it is desirable to include a rotational control device 150 having a robust fluid seal. The reinforced seal 126 may also be useful downhole in a completion string to separate pressure zones in a well after the completion of drilling activities. Similar components in FIGS. 1 and 2 are identified with similar reference numerals.

The well 102 is formed by a drilling process in which a drill bit 116 is turned a drill string 120 that extends from the drill bit 116 to the surface 108 of the well 102. The drill string 120 may be made up of one or more connected tubes or pipes of varying or similar cross-cross-section that are connected and lowered into the well 102. The drill string 120 may refer to the collection of pipes or tubes as a single component, or alternatively to the individual pipes or tubes (drill pipes) and tooling connections that make up the string 120. The term drill string is meant to be limiting in nature and may refer to any component or components that are capable transferring rotational energy from the surface of the well to the drill bit 116. In several embodiments, the drill string 120 may include a central passage disposed longitudinally in the drill string 120 and capable of allowing fluid communication between the surface 108 of the and downhole locations.

At or near the surface 108 of the well 102, the drill string 120 may include or be coupled to a kelly 128. The kelly 128 may have a square, hexagonal or octagonal cross-section. The kelly 128 is connected at one end to the remainder of the drill string 120 and at an opposite end to a rotary swivel 132. The kelly passes through a rotary table 136 that is capable of rotating the kelly 128 and thus the remainder of the drill string 120 and drill bit 116. The rotary swivel 132 allows the kelly 128 to rotate without rotational motion being imparted to the rotary cable 142. A hook 138, the cable 142, a traveling block (not shown), and a hoist (not shown) are provided to lift or lower the drill bit 116, drill string 120, kelly 128 and rotary swivel 132. The kelly 128 and swivel 132 may be raised or lowered as needed to add additional sections of tubing to the drill string 120 as the drill bit 116 advances, or to remove sections of tubing from the drill string 120 if removal of the drill string 120 and drill bit 116 from the well 102 is desired.

As noted above, the managed pressure drilling system 100 includes rotating control device 150, which functions to seal the system, diverts flow away from the rig floor into the wellbore 106, and complements the rig's standard blowout preventer 152. The rotating control device 150 forms a friction seal around the drill string 120 or kelly 128 to create a closed loop drilling system. The rotating control device 150 may be configured to withstand a preselected static pressure differential. For example, the preselected static pressure differential may be 1,000, 2,500, or 5,000 psi. The rotating control device 150 may also include a dual stripper, or second reinforced seal 126, to create a secondary barrier for safer operation.

In addition to managed pressure drilling configurations, the rotating control device may also be used in underbalanced drilling and in conventional overbalanced drilling as extra layer of protection against kicks. Managed pressure drilling is typically performed by controlling the well bore pressure so that it is above the well pore pressure and below the well fracture pressure. Conversely, underbalanced drilling is performed by maintaining the well bore pressure at a pressure that it is below the well pore pressure and therefore allows the well to produce during drilling operations. Regardless of the drilling configuration, the rotating control device is used to seal the well from atmosphere and direct mud, gas and any hydrocarbons that may be produced to equipment located on the surface 108 or on the rig.

In a representative drilling system, rotating control device 150 is located above the blow-out preventer 152, which is typically above surface 108, or above the water line in most off shore applications. The rotating control device is typically made up of a cylindrical body with side ports and a bearing assembly that typically is clamped into the top of the body.

According to an illustrative embodiment, the reinforced seal 126 is configured to maintain the desired pressure differential across the rotating control device 150. During drilling operations, the drill string 120 is run down through the center of the seal and the reinforced seal 126 is mounted to a bearing to facilitate rotation of the drill string 120. This seal may be created by compressing a surface of a drill pipe against a complementary surface of the reinforced seal 126. The reinforced seal 126 may be flexible to allow for tool joints having an enlarged diameter relative to the normal outer diameter of the drill pipe to pass through as the drill pipe is lowered into a wellbore.

The reinforced seal 126 creates a fluid seal against the drill string 120 to prevent the unwanted egress of drilling fluid or other fluids from the wellbore 106. The reinforced seal 126 may be relied upon to maintain a pressure differential and may be mechanically robust to allow tool joint connections to pass through the reinforced seal 126. To prevent such undesired failures, a metal backup ring may be bonded to the elastomer to reinforce the elastomeric seal. As discussed in more detail below, the metal backup ring may be segmented since the wellhead element expands and contracts around tool joints as the drill string is lowered into the well 102. However, such a segmented metal backup ring, if bonded to the elastomer, may create localized strain concentrations in the elastomer at locations that correspond to gaps in the segments of the metal backup ring. This too may result in premature failure of the elastomer. In the illustrative embodiments described below, high-expansion sealing mechanisms with metal backup layers are described that provide an elastomeric seal reinforced by a modified, segmented reinforcement layer. The reinforced seal 126 is described in more detail with regard to FIGS. 3-8 below.

The drill string 120 may include a number of tool joints 160 that, when viewed as an external profile, appear as sections of drill string 120 having an enlarged outer diameter. The tool joints 160 may correspond to tool locations or other junctions within the drill string As shown in FIGS. 1 and 2, in normal operation, drilling fluid 140 is stored in a drilling fluid reservoir 110 and pumped into an inlet conduit 144 using a choke 146 that includes a pump, or plurality of pumps disposed along the inlet conduit 144. The choke 146 is the pressure regulator of the managed pressure drilling system. In an embodiment, the choke 146 functions to control the wellhead pressure to a set point, and may be constantly adjusted to account for changes in flow rate to maintain the desired bottom hole pressure.

Drilling fluid 140 passes through the inlet conduit 144 and into the drill string 120 via a fluid coupling at the rotary swivel 132. The drilling fluid 140 is circulated into the drill string 120 to maintain pressure in the drill string 120 and wellbore 106 and to lubricate the drill bit 116 as it cuts material from the formation 112 to deepen or enlarge the wellbore 106. After exiting the drill string 120, the drilling fluid 140 carries cuttings from the drill bit 116 back to the surface 108 through an annulus 148 formed by the space between the inner wall of the wellbore 106 and outer wall of the drill string 120. At the rotating control device 150, the drilling fluid 140 exits the annulus 148 and is directed out of side ports in the rotating control device 150 to a repository. If the drilling fluid 140 is recirculated through the drill string 120, the drilling fluid 140 may return to the drilling fluid reservoir 110 via an outlet conduit 164 that couples the annulus 148 to the drilling fluid reservoir 110. The path that the drilling fluid 140 follows from the reservoir 110, into and out of the drill string 120, through the annulus 148, and to the repository may be referred to as the fluid flow path.

Figure 3:
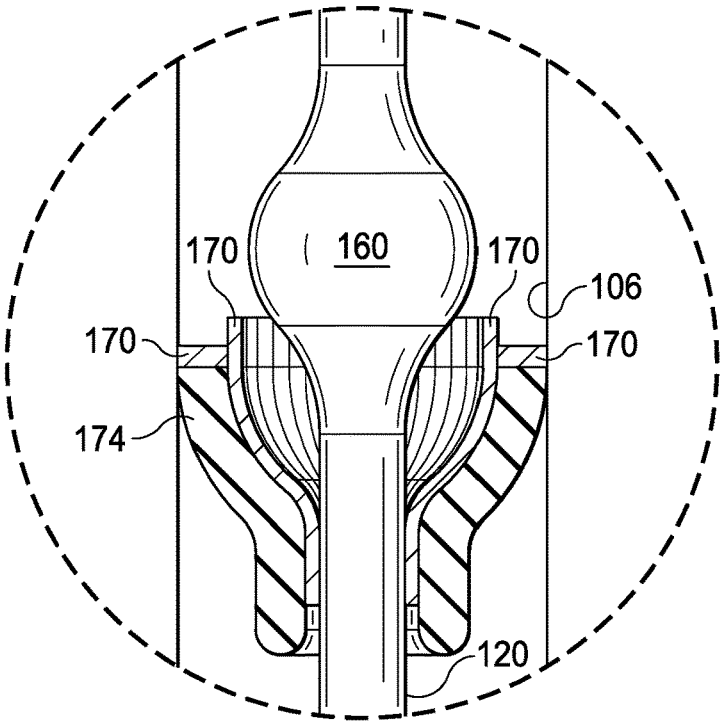
FIG. 3 is a detail view, in partial cross-section, showing an embodiment of a reinforced seal downhole from a tool joint of a drill string, a representative location of which is indicated in FIG. 1.
Figure 4:
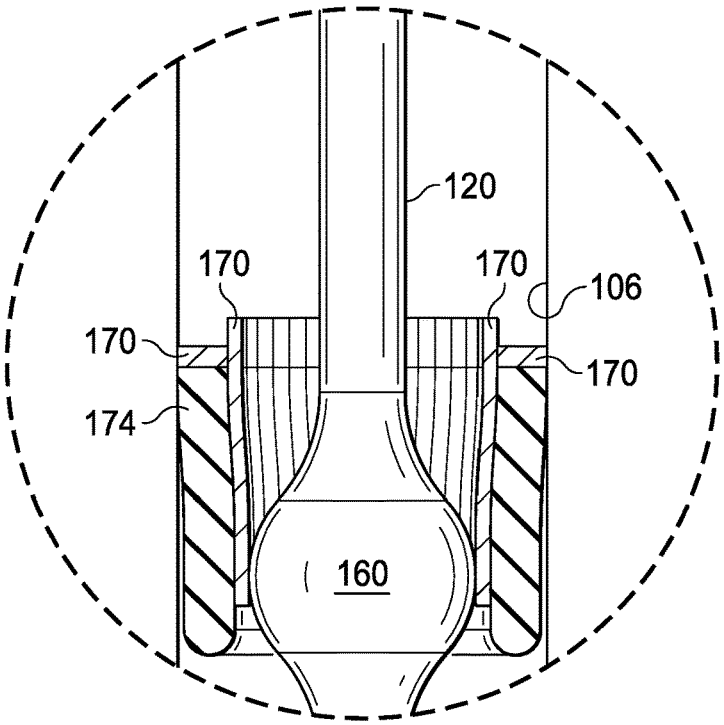
FIG. 4 is a side view, analogous to the detail view of FIG. 3, showing the tool joint passing through the reinforced seal.
Figure 5:
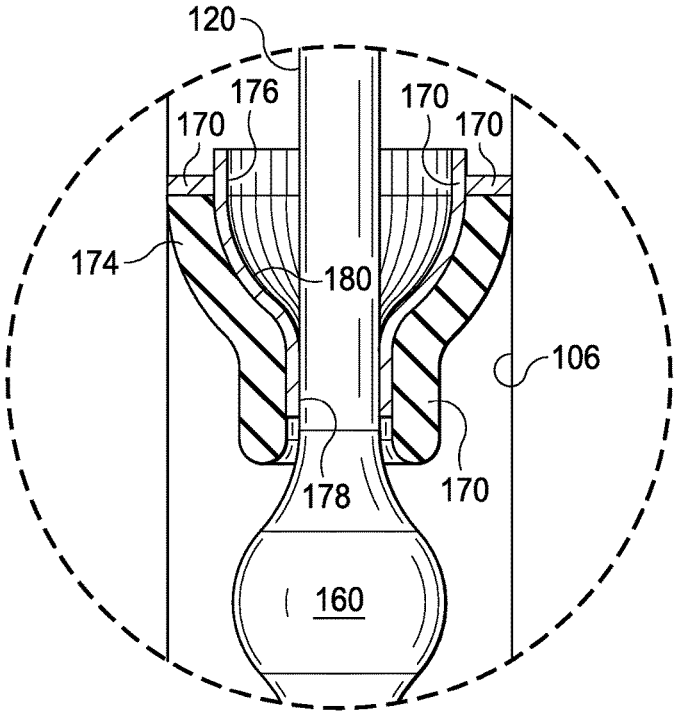
FIG. 5 is a side view, analogous to the detail view of FIG. 3, showing the tool joint having passed through the reinforced seal.

As noted above, the drill string 120 may be raised or lowered to add or remove segments as the well is drilled deeper or as components of the drill string need to be replaced. As such, FIGS. 3-5 show that portions of the managed pressure drilling system 100 may be configured to enable the raising and lowering of the drill string 120 without the need to interrupt the fluid seal between the external environment and the wellbore 106. For example, the reinforced seal 126 of the rotating control device 150 may be designed to expand to allow the passage of tool joints 160 and other expanded portions of the drill string 120 into the wellbore 106 without interruption of the fluid seal at the interface between the drill string 120 and reinforced seal 126.

FIG. 3 shows a detail view of the tool joint connection 160 being lowered into a wellbore 106 as the tool joint connection 160 is about to pass through a reinforced seal 126. As shown, the reinforced seal 126 includes an elastomeric layer 174 having a bullnose cross-section. The nose of the elastomeric layer seals about the outer surface of the drill string 120 to maintain a pressure differential. To facilitate the engagement of the reinforced seal 126 and the drill string 120, the reinforced seal 126 includes a backup layer 170.

In an embodiment, the elastomeric layer 174 seals against drill string 120 and reinforced by the backup layer 170, which is formed from slats 172. The slats 172 may be from titanium, steel, aluminum, or any other metal that is suitable for interfacing with the drill string 120. In another embodiment, the slats may be formed from a ceramic or a polymer. In embodiment shown in FIG. 6, the slats 172 are substantially axially aligned along the direction the wellbore 106 and spaced circumferentially about the perimeter of the wellbore 106 along the internal surface of the reinforced seal 126. In another embodiment, the slats 172 are canted or angled such that each slat 172 follows a helical path along the surface of the elastomeric layer 174.

Figure 6:
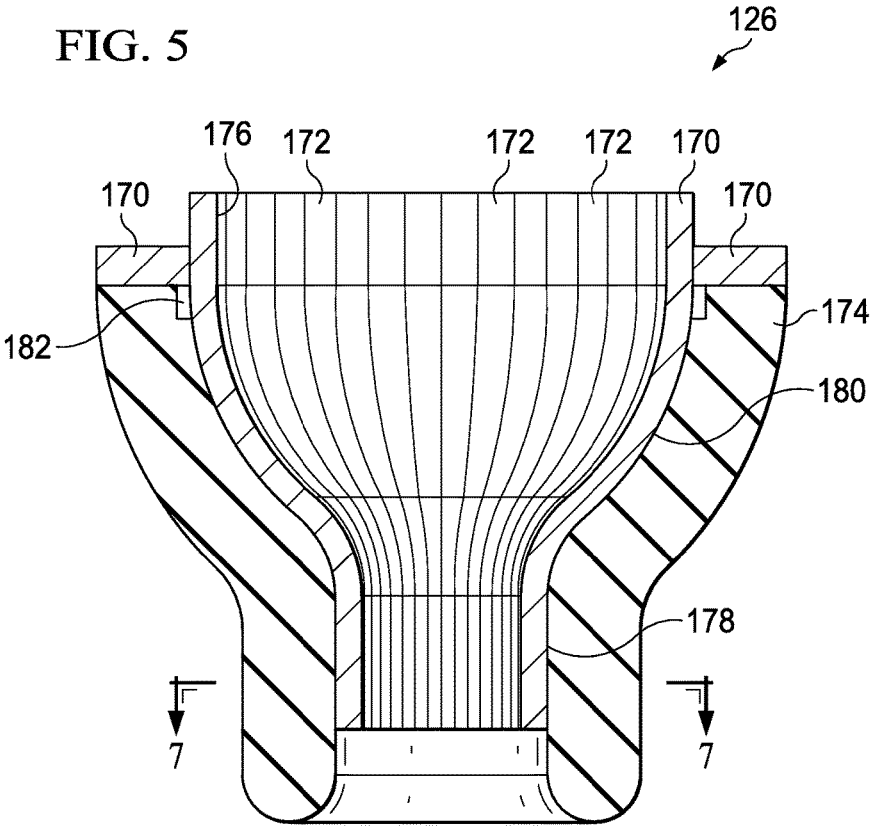
FIG. 6 is a side, cross-section view of the reinforced seal of FIGS. 3-5 having a plurality of louvered slats.
Figure 8:
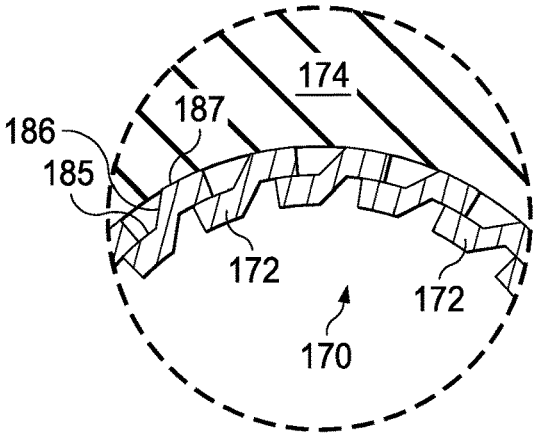
FIG. 8 is a detail, section view showing overlapping louvered slats of a backup layer of the reinforced seal of FIG. 3.

In the embodiment of FIG. 6, for example, the slats 172 are louvered plates that slide underneath adjacent slats 172 to prevent the slats 172 from digging into and degrading the elastomer when the reinforced seal 126 expands and contracts as described below. FIGS. 5 and 6 illustrate an embodiment in which the slats 172 are shaped metal slats having louvered features such that a portion of each slat underlies and reinforces a portion of an adjacent louvered slat. As referenced herein, the term "louvered" refers to the arrangement and geometry of the slats 172. For example, "louvered" slats 172 are slats 172 that are arranged such that each slat 172 partially underlies a preceding, adjacent slat 172 on one side and partially overlies a succeeding, adjacent slat 172 on the other in a manner similar to slats in a window shutter. Each individual slat 172 may be flat, or may include a louvered geometric feature that makes the slat 172 more suitable for arrangement in a louvered configuration. For example, each slat 172 may be formed to include offset flat or curved portions that are separated by a bend or series of bends, which may also be referred to as a jog 186, as shown in FIG. 8. If the slats are formed from sheet metal, the jog 186 may be formed by fixing a first segment 185 of the slat 172 relative to an offset die and applying a punch to an unfixed portion of the slat 172. Application of the punch will result in deformation of the unfixed portion of the slat 172 to form the jog 186 and an offset second segment 187 of the slat 172 corresponding to the surface of the offset die. The slat 172 may also be formed using a bend or series of bends that form a louvered geometric feature. In the embodiment of FIG. 8, the slats 172 may be formed by stamping or hydroforming sheet metal, casting, machining, a combination thereof, or any other suitable method of fabrication. The louvered arrangement of slats 172 described above enables the entire circumference of the reinforced seal 126 to be reinforced by a single layer of overlapping slats 172.

In an embodiment, the reinforced seal 126 includes a first end portion 176 that has a larger opening, or inner diameter at a first end and a smaller second end portion 178 a smaller diameter opening at a second, opposing end. The first end portion and second end portion are separated by a tapered portion 180 where the inner diameter of the first end portion 176 transitions to the smaller inner diameter of the second end portion 178. The second end portion 178 is formed to have an inner diameter that is approximately the same or less than the outer diameter of the drill string 120 such that the reinforced seal 126 will form a compressive seal about the perimeter of the drill string 120. The first end portion 176 is formed to have an inner diameter that is slightly larger than the outer diameter of the tool joint connection 160 in order to facilitate the passage of the tool joint connection 160 through the reinforced seal 126 as the drill string 120 is lowered into the wellbore 106.

The tapered portion 180 facilitates the passage of the tool joint 160 into the smaller diameter of the second end portion 176, whereupon the tool joint 160 will exert an outward force as the tool joint 160 engages the surface of the tapered portion 180, causing the smaller diameter of the second end portion 178 and tapered portion 180 to expand as the tool joint 160 moves down into the wellbore 106, as shown in FIG. 4. After the tool joint 160 has passed through the reinforced seal 126, the elasticity of the elastomeric layer 174 causes the reinforced seal 126 to contract and form a compressive seal against the outer surface of the drill string 120 as shown in FIG. 5.

Figure 7:
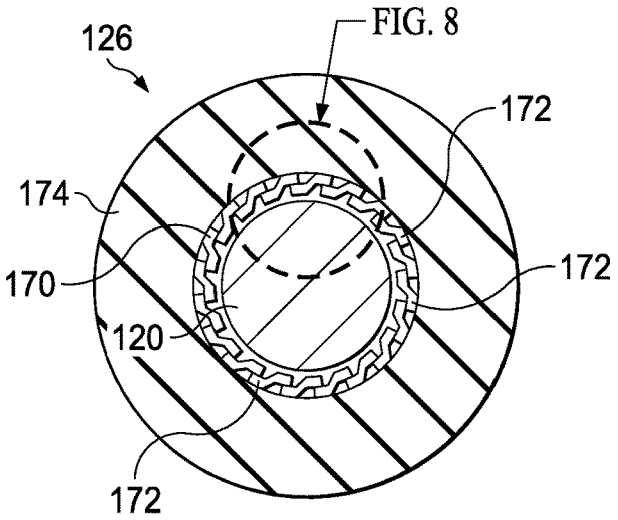
FIG. 7 is a top, cross-section view of the reinforced seal, taken along the arrows 7-7 in FIG. 6.

FIGS. 6-8 illustrate that, in an embodiment, a portion of the elastomeric layer 174 extends below the slats 172 of the backup layer 170 to seal against the drill string 120 at the second end of the reinforced seal 126, which corresponds to the smaller diameter of the second end portion 178. The backup layer 170 and elastomeric layer 174 may be bonded together using a weld, adhesive, or any other suitable bond at the first end of the reinforced seal 126, corresponding to the larger diameter of the first end portion 176. In another embodiment, the backup layer 170 and elastomeric layer 174 are each bonded to a common substrate 182 that fixes the backup layer 170 and elastomeric layer 174 relative to each other at or near the first end portion of the reinforced seal 126. The common substrate may be a ceramic, polymer, or metal layer, or a layer of adhesive. In each case, the bonded portion of the backup layer 170 and elastomeric layer 174 may occupy all or a portion of the larger diameter of the first end portion 176, where the elements of the reinforced seal 126 will not experience significant deformation and associated relative movement as a tool joint 160 passes through the reinforced seal 126 and into the wellbore 106.

Through the lower portion of the reinforced seal 126 corresponding to second portion 176, tapered portion 180, and lower part of the of the first end portion 176, the backup layer 170 and elastomeric layer 174 are free to float relative to each other, thereby avoiding concentrations of strain in the elastomeric layer 174 that would result from a bonded portion of the elastomeric layer undergoing significant expansion and contraction. Providing a partially floating interface between a backup layer 170 that completely surrounds the circumference of elastomeric layer 174 through the body of the reinforced seal 126 allows the backup layer 170 provide reinforcement to the elastomeric layer 174. Allowing the backup layer 170 to float prevents unwanted extrusion of the elastomeric layer 174 when there is a significant pressure differential across the reinforced seal 126 without creating strains in the elastomer.

In an embodiment, an internal surface of the backup layer 170 may be coated with a lubricating layer that provides a low-friction interface between the backup layer 170 and drill string 120 and tool joint 160 to facilitate relative movement between the backup layer 170 and tool joint 160. Such a lubricating layer may be formed from a ceramic, glass, or polymer selected to prevent unwanted sticking between the reinforced seal 126 and the drill string 120.

Figure 9:
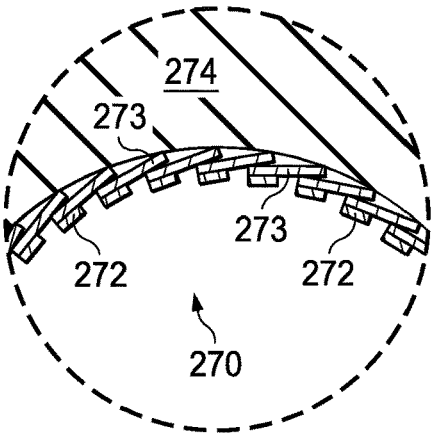
FIG. 9 is a detail view showing an alternative embodiment of a backup layer having louvered slats.

FIG. 9 shows an alternative embodiment of a reinforced seal that is similar in many respects to the reinforced seal 126 of FIGS. 1-8. Like the reinforced seal 126 of FIGS. 1-8, the reinforced seal 226 of FIG. 9 also includes an elastomeric layer 274 and a backup layer 270. In an embodiment according to FIG. 9, the backup layer 270 also comprises louvers 273; however, the louvers 273 are formed from a single layer of flat, unshaped material, such as a titanium, aluminum, steel alloy, polymer, ceramic, or any other suitable material that is suitable for contacting the material of the drill string without inducing galvanic corrosion or excessive wear. To reinforce the elastomeric layer 274, a portion of each louver 273 overlaps a portion of each adjacent louver 273. The louvers 273 are shown as being relatively thin layers of material and as such, each louver may have a metal slats 272 bonded to it the portion of the louver 273 that overlies the adjacent louver 273 to add rigidity to the backup layer 270.

Figure 10:
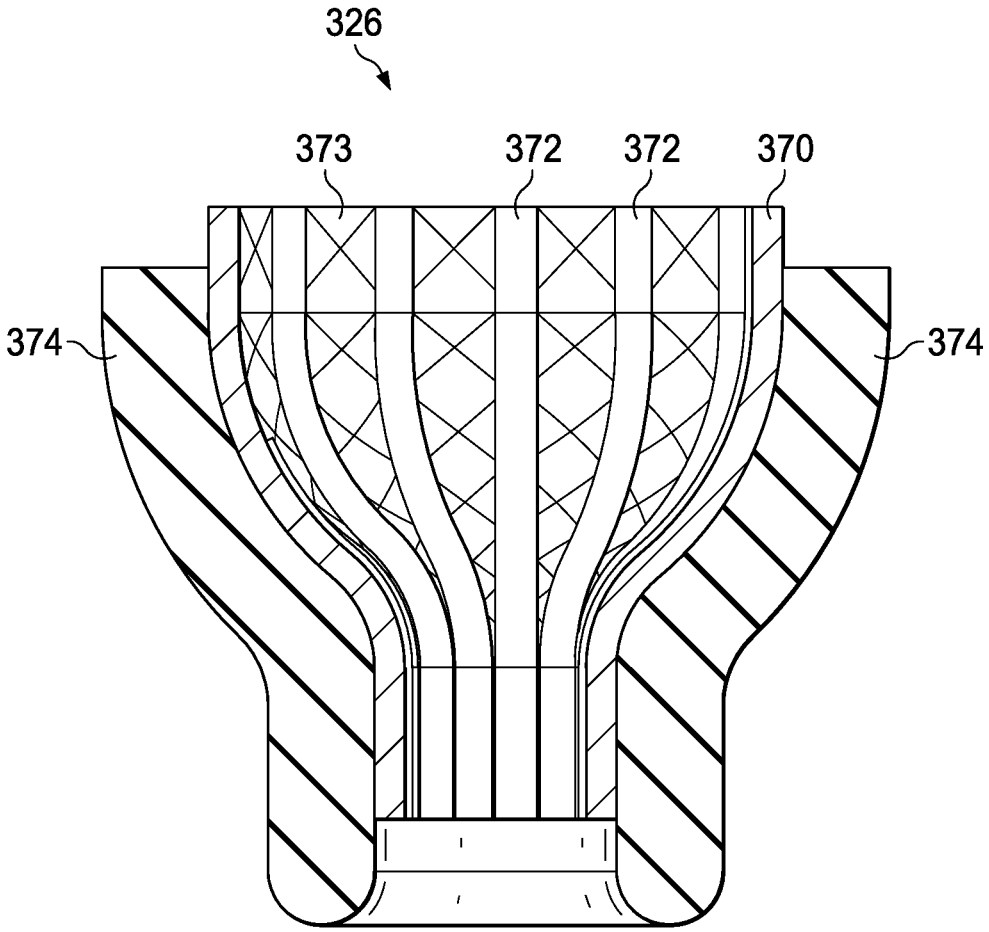
FIG. 10 is a side view of a reinforced seal having a mesh layer between the backup layer and an elastomeric layer.

In another embodiment, as shown in FIG. 10, the reinforced seal 326 is formed from an elastomeric layer 374 and backup layer 370, similar in many respects to those discussed above. Rather than including louvers to support the elastomeric layer at gaps between the slats 372, however, the backup layer 370 includes a mesh layer 373 to isolate the elastomeric layer 374 from the slats 372 to prevent the edges of the slats 372 from degrading the elastomeric layer 374 as the reinforced seal 326 expands and contracts. In this embodiment, the mesh layer 373 is an expandable mesh having spring characteristics. The resilient, spring-like characteristics of the mesh enable a portion of the mesh layer 373 that lines the smaller diameter portion of the reinforced seal 326 to expand to accommodate the passage of a tool joint and contract to its original diameter after passage of the tool joint.

The reinforced seal and related systems and methods may be described using the following examples:

Example 1

A reinforced seal for maintaining a pressure differential in a well bore, the reinforced seal comprising: an elastomeric layer; a partially floating backup layer between a drill pipe and the elastomeric layer at the wellhead, the partially floating backup layer having: a first end portion and a second end portion, the first end portion having a larger inner diameter than the second end portion, a tapered portion connecting the first end portion and second end portion, and a plurality of slats arranged circumferentially about the perimeter of the drill pipe along the internal surface of the backup layer such that a portion of each slat underlies portion of each adjacent slat.

Example 2

The reinforced seal of example 1, wherein each of the plurality of slats has a louvered portion.

Example 3

The reinforced seal of examples 1 and 2, wherein the elastomeric layer extends further into the wellhead than the metal layer at the second end of the partially floating backup layer.

Example 4

The reinforced seal of examples 1-3, wherein the metal layer and elastomeric layer are fixed, relative to one another, by a bond that is proximate the distal end of the first end portion.

Example 5

The reinforced seal of example 4, wherein the partially floating backup layer and elastomeric layer are bonded to a common substrate.

Example 6

The reinforced seal of examples 1-5, further comprising a non-metallic, lubricating layer formed from ceramic, glass, or a polymer attached to an inner surface of the metal layer to prevent unwanted sticking between the partially floating backup layer and the drill string.

Example 7

The reinforced seal of examples 1-6, wherein the partially floating backup layer further comprises an expandable mesh layer.

Example 8

A system for sealing a drill pipe against a wellhead; the system comprising: an elastomeric layer; and a partially floating backup layer between the drill pipe and the elastomeric sealing layer at the wellhead to reinforce the elastomeric layer, the partially floating backup layer having a first end portion, a second end portion, and a tapered portion, wherein the first end portion has a larger inner diameter than the second end portion and the tapered portion connects the first end portion and second end portion, and wherein the partially floating backup layer comprises an expandable mesh layer.

Example 9

The system of example 8, wherein the elastomeric layer extends further into the wellhead than the partially floating backup layer at the tapered end of the partially floating backup layer.

Example 10

The system of examples 8-9, wherein the partially floating backup layer and elastomeric layer are fixed, relative to one another, at the distal end of the first end portion.

Example 11

The system of example 10, wherein the partially floating backup layer and elastomeric layer are bonded to a common substrate.

Example 12

The system of examples 8-11, further comprising a non-metallic, lubricating layer formed from ceramic, glass, or a polymer attached to an inner surface of the partially floating backup layer to prevent unwanted sticking between the partially floating backup layer and the drill pipe.

Example 13

The system of examples 8-12, wherein the partially floating backup layer further comprises a plurality of slats substantially aligned with the longitudinal axis of the drill pipe and arranged circumferentially about the perimeter of the drill string, and wherein each of the plurality of slats is coupled to the expandable mesh layer.

Example 14

A method for sealing a drill pipe in a managed pressure drilling environment, the method comprising: providing an elastomeric layer adjacent a wellhead in a wellbore; providing a partially floating backup layer adjacent the elastomeric layer, wherein the partially floating backup layer comprises: a first end portion and a second end portion, the first end portion having a larger inner diameter than the second end portion, a tapered portion, and a plurality of slats substantially aligned with the longitudinal axis of the drill pipe and arranged circumferentially about the perimeter of the drill pipe along the internal surface of the backup layer such that a portion of each slat underlies a portion of each adjacent slat; and inserting a portion of the drill pipe into the wellbore.

Example 15

The method of example 14, wherein each of the plurality of slats has a louvered portion.

Example 16

The method of examples 14 and 15, wherein the elastomeric layer extends further into the wellhead than the partially floating backup layer at the tapered end of the partially floating backup.

Example 17

The method of examples 14-16, further comprising fixing the partially floating backup layer and elastomeric layer relative to one another at the distal end of the first end portion.

Example 18

The method of example 17, wherein fixing the partially floating backup layer and elastomeric layer relative to one another comprises bonding the partially floating backup layer and elastomeric layer to a common substrate.

Example 19

The method of examples 14-18, further comprising providing a non-metallic, lubricating layer adjacent an inner surface of the partially floating backup layer.

Example 20

The method of examples 14-19 wherein the metal backup layer further comprises an expandable mesh layer.

Example 21

The reinforced seal of example 1, wherein the plurality of slats are substantially aligned with the longitudinal axis of the drill pipe.

Example 22

The reinforced seal of example 1, wherein the plurality of slats are canted relative to the longitudinal axis of the drill pipe.

It should be apparent from the foregoing that embodiments of an invention having significant advantages have been provided. While the embodiments are shown in only a few forms, the embodiments are not limited but are susceptible to various changes and modifications without departing from the spirit thereof.

We claim:

1. A reinforced seal for maintaining a pressure differential in a well bore, the reinforced seal comprising:

an elastomeric layer; and a backup layer between a drill pipe and the elastomeric layer, the backup layer having:

a first end portion and a second end portion, the first end portion having a larger inner diameter than the second end portion, a tapered portion connecting the first end portion and second end portion, and a plurality of slats arranged circumferentially about the perimeter of the drill pipe along an internal surface of the elastomeric layer such that a portion of each slat underlies a portion of an adjacent slat, wherein the backup layer and elastomeric layer are bonded to a common substrate along a complete circumference of an inner surface of the elastomeric layer at the first end portion of the backup layer.

2. The reinforced seal of claim 1, wherein each of the plurality of slats comprises two approximately flat segments separated by a jog.

3. The reinforced seal of claim 1, wherein the elastomeric layer extends further into a wellhead than the backup layer at the second end of the backup layer.

4. The reinforced seal of claim 1, wherein the backup layer and elastomeric layer are fixed, relative to one another, by a bond that is proximate a distal end of the first end portion.

5. The reinforced seal of claim 1, further comprising a non-metallic, lubricating layer formed from ceramic, glass, or a polymer attached to an inner surface of the backup layer to prevent unwanted sticking between the backup layer and the drill pipe.

6. The reinforced seal of claim 1, wherein the backup layer further comprises an expandable mesh layer.

7. A system for sealing a drill pipe proximate a wellhead; the system comprising:

an elastomeric layer; and a backup layer between the drill pipe and the elastomeric layer to reinforce the elastomeric layer, the backup layer having a first end portion, a second end portion, and a tapered portion, wherein the first end portion has a larger inner diameter than the second end portion and the tapered portion connects the first end portion and second end portion, and wherein:

the backup layer and elastomeric layer are bonded to a common substrate along a complete circumference of an inner surface of the elastomeric layer at the first end portion of the backup layer; and the backup layer comprises an expandable mesh layer.

8. The system of claim 7, wherein the elastomeric layer extends below the backup layer at the second end portion of the backup layer.

9. The system of claim 7, wherein the backup layer and elastomeric layer are fixed, relative to one another, at a distal end of the first end portion.

10. The system of claim 7, further comprising a non-metallic, lubricating layer formed from ceramic, glass, or a polymer attached to an inner surface of the backup layer.

11. The system of claim 7, wherein the backup layer further comprises a plurality of slats substantially aligned with a longitudinal axis of the drill pipe and arranged circumferentially about the perimeter of the drill pipe, and wherein each of the plurality of slats is coupled to the expandable mesh layer.

12. A method for sealing a drill pipe in a managed pressure drilling environment, the method comprising:

providing an elastomeric layer adjacent a wellhead in a wellbore;

providing a backup layer adjacent the elastomeric layer, wherein the backup layer comprises:

a first end portion and a second end portion, the first end portion having a larger inner diameter than the second end portion, a tapered portion connecting the first end portion and second end portion, and a plurality of slats arranged circumferentially about the perimeter of the drill pipe along an internal surface of the elastomeric layer such that a portion of each slat underlies a portion of an adjacent slat, wherein fixing the backup layer and elastomeric layer relative to one another comprises bonding the backup layer and the elastomeric layer to a common substrate along a complete circumference of an inner surface of the elastomeric layer at the first end portion of the backup layer; and inserting a portion of the drill pipe into the wellbore.

13. The method of claim 12, wherein each of the plurality of slats comprises two curved segments separated by a jog.

14. The method of claim 12, wherein the elastomeric layer extends further into the wellhead than the backup layer at second end portion of the backup layer.

15. The method of claim 12, further comprising fixing the backup layer and elastomeric layer relative to one another at a distal end of the first end portion.

16. The method of claim 12, further comprising providing a non-metallic, lubricating layer adjacent an inner surface of the backup layer.

17. The method of claim 12 wherein the backup layer further comprises an expandable mesh layer.

* * * * *